US005916723A

United States Patent [19]

Hand

[11] Patent Number: 5,916,723

[45] Date of Patent: Jun. 29, 1999

[54] METHOD FOR TRANSFERRING IMAGES ONTO SUBSTRATES

[76] Inventor: John E. Hand, 3132 N. Bayberry Rd., Warsaw, Ind. 46580

[21] Appl. No.: 08/855,850

[22] Filed: May 12, 1997

[51] Int. Cl.[6] ..... G03G 13/16

[52] U.S. Cl. ..... 430/126; 430/47; 101/492

[58] Field of Search ..... 430/126, 47; 101/492

[56] References Cited

U.S. PATENT DOCUMENTS

| | | | |
|---|---|---|---|
| 2,947,625 | 8/1960 | Bertelsen | 430/31 |
| 4,027,049 | 5/1977 | Masuda et al. . | |
| 4,268,595 | 5/1981 | Katagiri et al. | 430/48 |
| 4,464,505 | 8/1984 | Kawakami et al. | 524/512 |
| 5,240,810 | 8/1993 | Barjesteh | 430/257 |
| 5,277,992 | 1/1994 | Shinohara et al. | 428/704 |
| 5,298,355 | 3/1994 | Tyagi et al. | 430/110 |
| 5,302,576 | 4/1994 | Tokiyoshi et al. | 503/227 |
| 5,306,590 | 4/1994 | Felder | 430/115 |
| 5,312,711 | 5/1994 | Tavernier et al. | 430/110 |
| 5,330,869 | 7/1994 | Wilson et al. | 430/106.6 |
| 5,332,459 | 7/1994 | Imai et al. | 156/234 |
| 5,332,637 | 7/1994 | Wilson et al. | 430/106.6 |
| 5,358,820 | 10/1994 | Bugner et al. | 430/126 |
| 5,376,432 | 12/1994 | Umise et al. | 428/195 |
| 5,418,057 | 5/1995 | Tokiyoshi et al. | 428/323 |
| 5,420,613 | 5/1995 | Saisho et al. | 347/217 |
| 5,432,258 | 7/1995 | Yoshimura | 428/414 |
| 5,446,012 | 8/1995 | Ito et al. | 303/227 |
| 5,462,829 | 10/1995 | Tyagi et al. | 430/109 |
| 5,487,614 | 1/1996 | Hale | 400/120.02 |
| 5,522,317 | 6/1996 | Hale et al. | 101/488 |

OTHER PUBLICATIONS

Stahls', Inc.;"Stahls' Introduces New LaserTrans™ Technology"; 1996; St. Clair Shores, Michigan.

Nova Chrome™; Sublimation Products; Oct. 1996; Pleasant Hill, California.

*Primary Examiner*—John Goodrow

*Attorney, Agent, or Firm*—Lundy and Associates

[57] ABSTRACT

An improved method for transferring single and multicolored images on to substrates having the following process steps. Copying a mirror image of the image on to a transfer sheet using pigmented softenable ink, placing the transfer sheet with the mirror image thereon against the substrate with the image and pigmented softenable ink therebetween, softening the ink and bonding the image to the substrate, and removing the transfer paper leaving the image in pigmented ink on the substrate.

36 Claims, 2 Drawing Sheets

METHOD FOR TRANSFERRING IMAGES ONTO SUBSTRATES

BACKGROUND OF THE INVENTION

The present invention relates to a method for transferring images onto substrates and more particularly to an improved method of transferring single color or multicolored images onto substrates quickly and inexpensively, and to produce permanent highly desirable images on such substrates pleasing to the eye.

It has long been highly desirable to provide images on substrates. Plaques and other wall hangings, ornamental shirts and other clothing, license plates, and ornamental craft items have all been made by transferring images onto substrates. In the past, images have been transferred onto substrates by using masks, etching, photocopying, ink and dye sublimation, and ink jet, laser and other printing techniques.

Masks have been placed over substrates and color has been applied to the substrate through the mask to recreate performed images. In this manner, a performed image is transferred onto the substrate. In the most sophisticated mask processes. the substrate is prepared and coated with a photo resistant coating. Photographically an image is placed on the coating, the coating is developed leaving a mask on the substrate. The substrate is then etched and/or colored, and the mask and/or the remainder of the colored pigment is removed from the substrate. These processes usually include many process steps which are time consuming. While masks made by photographic means have become more prevalent and the materials from which they are made have become less expensive and more available, their use is still cumbersome and not as quick or inexpensive as other transfer methods. Additionally, etching materials are usually acidic and have restrictions in commercial operations as to their disposal and use by government regulations.

While pigments have been available and improved, it has been difficult to transfer multicolored images to substrates using any mask or etching process. Any such multicolored transfer process would include multiple masks and multiple pigments and a highly complex time consuming and expensive process. It is therefore highly desirable to provide an improved method for transferring images onto substrates. It is also highly desirable to provide a new and improved transfer process for transferring both single color and multicolor images to substrates which would be less expensive, less cumbersome, less time consuming and more inexpensive than existing mask or etching transfer processes. It is also highly desirable to provide an improved method for transferring images on to substrates which does not require the images to be recreated on the substrate.

The photocopy process used in most office photocopiers readily transfer both black and white and multicolored images to other substrates. Each of these processes utilize a positioning of pigmented toner onto the substrate in the exact form of the image, usually by electrostatic charge and then processing the pigment into a fixed image on the substrate, usually by the application of heat. Laser printers utilize a similar process. Such a process has less steps, is less complex and less costly than prior mask or etching processes. Therefore it is also highly desirable to provide an improved method of transferring single color and multicolor images onto substrates which has all of the advantages of a photocopy process, and all of the flexibility of a mask or etching process, but none of the disadvantages of either process.

Sublimation of inks or dyes from one medium to another has also been used to transfer images to substrates. Some printers have utilized such a process. Thus, multicolored sublimation inks and dyes and thermal sublimation papers are available. However, the sublimation process has not been preferred due to the limitations of the dyes and dye colors and the necessity of special transfer papers having dye acceptable coatings thereon and heat resistant substrates which are not as highly regarded as other transfer papers and substrates. Thus, it is also highly desirable to provide an improved method to transfer images to a substrate which has all of the advantages of sublimation in the number of steps, the cost of materials, the length of time and complexity of the method, but which utilizes the pigments of mask and photocopy processes and has all of the flexibility of a mask or photocopy process, and none of the disadvantages.

Most ink jet and laser printers are capable of producing detailed single and multicolored images onto substrates. Such printers like photocopy processes and sublimation processes, each require the substrate on which the image is to be transferred to be positioned relative to the ink jets or the original image within close tolerances. This usually requires the substrate to be advanced by a series of rollers. Such limits the substrate in most of the processes to thin sheet materials and usually flexible materials of a uniform size and thickness such as paper or fabric or plastic sheets. Thus it is also highly desirable to provide an improved method of transferring single color and multicolor images onto substrates which has all of the advantages of inkjet and laser printers, but none of the disadvantages.

Most present image transfer methods, especially onto complex substrates (i.e., not paper thin), require several time consuming operations to produce a substrate with a single color or multicolor design permanently affixed thereto, require a high level of skill only obtainable at high wages are costly to perform, or do not have much versatility. It is therefore also highly desirable to provide an improved method for transferring single color or multicolored images on to substrates which can be accomplished by low skill workers and customized.

Printing with permanent pigments onto substrates has always been expensive when producing one or limited quantities of customized printed substrates. Silk screening is a method often used, but silk screening is not cost effective for single copies nor does it have the ability to produce the fine detail. Thus, it is also highly desirable to produce an improved method of transferring images onto substrates which is less expensive than current methods, fully adaptable to single or limited copy quantities at reasonable prices, and produces the detail of photography or photocopying.

It is also highly desirable to provide an improved method for transferring single color or multicolored images onto substrates, permanently having the detail of photography in two simple steps performable with little skill, relatively quickly and easily.

It is also highly desirable to provide an improved method for transferring single color and multicolored images onto substrates which is not limited to thin sheet or flexible thin sheet materials, but may accommodate an unlimited range of sheet materials and oddly shaped objects.

It is also highly desirable to provide an improved method of transferring single color and multicolored images onto substrates which are not limited to the positioning of either the original or the substrate dimensionally relative to copier or printer apparatus within small tolerances or the nature of the substrate.

Finally, it is highly desirable to provide an improved method of transferring single color or multicolored images onto substrates which has all of the above features.

SUMMARY OF THE INVENTION

It is therefore an object of the invention to provide a new and improved transfer process for transferring both single color and multicolor images to substrates.

It is also an object of the invention to provide a new and improved transfer process for transferring both single color and multicolor images to substrates which would be less expensive, less cumbersome, less time consuming and more user friendly than prior mask or etching transfer processes.

It is also an object of the invention to provide a new and improved transfer process for transferring single color and multicolor images to substrates which does not require the images to be recreated on the substrate.

It is also an object of the invention to provide a new and improved transfer process for transferring single color and multicolor images to substrates which has all of the advantages of a photocopy process and all of the flexibility of a mask or etching process.

It is also an object of the invention to provide a new and improved transfer process for transferring single color and multicolor images to substrates which has all of the advantages of dye sublimation in the number of steps, the cost of materials, the length of time and complexity of the method, but which has all of the flexibility of a mask or etching process, but none of the disadvantages.

It is also an object of the invention to provide a new and improved transfer process for transferring single color and multicolor images to substrates which has all of the advantages of ink jet and laser printers, but none of the disadvantages.

It is also an object of the invention to provide an improved transfer process for transferring single color or multicolor images to substrates which can be accomplished by low skill workers and customized.

It is also an object of the invention to produce an improved transfer process for transferring single color and multicolor images to substrates which is less expensive than current methods and fully adaptable to single or limited copy quantities at reasonable prices, and produces the detail of photography or photocopying.

It is also an object of the invention to provide an improved transfer process for transferring single color or multicolor images to substrates, permanently having the detail of photography in two simple steps performable with little skill, relatively quickly and inexpensively.

It is also an object of the invention to provide an improved process for transferring single color and multicolor images to substrates which is not limited to thin sheet or flexible thin sheet materials, but may accommodate an unlimited range of sheet materials and oddly shaped objects.

It is also an object of the invention to provide an improved process for transferring single color and multicolor images to substrates which are not limited to the positioning of either the original or the substrate dimensionally relative to copier or printer apparatus within small tolerances or the nature of the substrate.

It is finally an object of the invention to provide an improved process for transferring single color or multicolor images to substrates which has all of the above features.

In the broader aspects of the invention there is provided an improved method for transferring single and multicolored images onto substrates having the following process steps. Copying a mirror image of the image onto a transfer sheet using pigmented softenable ink, placing the transfer sheet with the mirror image thereon against the substrate with the image and pigmented softenable ink therebetween, softening the ink and bonding the image to the substrate, and removing the transfer paper leaving the image in pigmented ink on the substrate.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
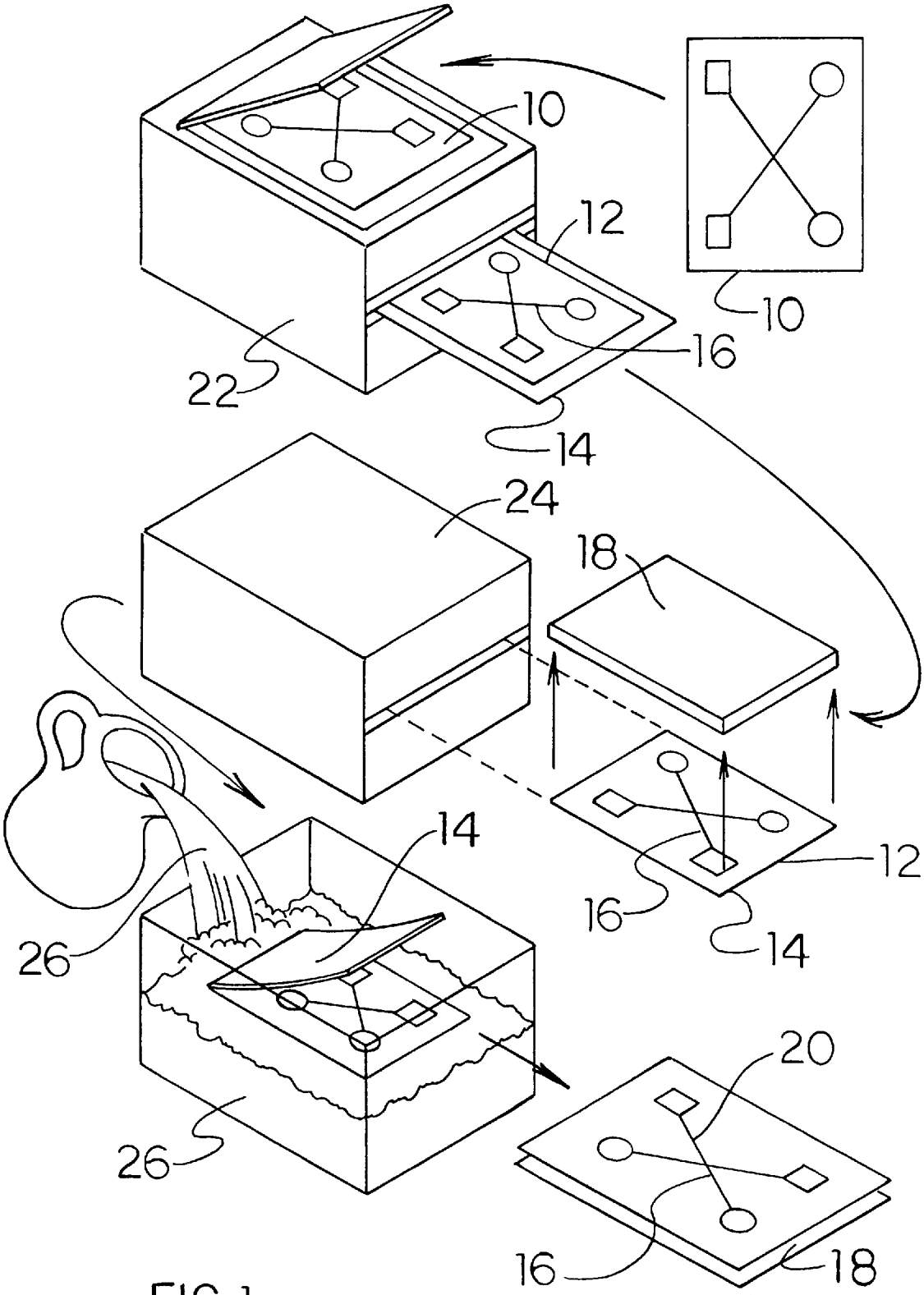
FIG. 1 is a diagrammatic view of the improved method of transferring single and multicolored images on to substrates of the invention.

The improved method for transferring single and multicolored images onto substrates includes the steps of producing an image 10, duplicating the image as a mirror image 12 on a transfer medium 14 in the color or colors desired in softenable ink 16, superimposing the transfer medium 14 on a desired substrate 18 to which the image is to be transferred with the mirror image 12 and the softenable ink 16 between the transfer medium 14 and the substrate 18 ensuring that the softenable ink image 12 is in contact with the substrate 18 at all positions therealong, softening the ink 16 of the mirror image 12 and bonding the mirror image 12 to the substrate 18, and removing the transfer medium 14 from the mirror image 12 leaving the image 12 on the substrate 18, and finishing the transferred image 20 on the substrate 18 as desired.

The image 10 may be produced in any medium known. The image could be a work of art in water colors or oils, a type written page or any other printed document, a photograph, an antique charcoal sketch, an architectural or engineering drawing, or any multimedia presentation that can either be put into computer memory or copied on a photocopy machine or printer using softenable inks 16. The images to which this invention pertains have no limits and would include any visually perceptive image including artistic designs, words or multimedia presentations.

The images 10 are duplicated as a mirror image 12 on a transfer medium 14 in the color or colors desired in a softenable ink or dye 16. The duplication can be accomplished by single color or multicolor photocopy machine or printer 22 utilizing powdered thermo-plastic toners, sublimation inks, or other softenable inks 16.

The term "dye" is used herein to refer to organic colorants, usually derived from coal tar and petroleum based intermediates. They include fugitive dyes which are unstable to sunlight and heat, and fast dyes which are not, and solvent dyes which are used in chlorinated hydrocarbon solvents each having an inherent problem with the affinity of each individual dye for a substrate surface as a result of the chemical nature of the dye and the physical state of the dye. Fugitive dyes are generally not preferred for use in the improved method for transferring single and multicolored images onto substrates of the invention.

The term "ink" relates to a viscous, flowable, semisolid suspension of finely divided pigment in a drying oil such as heat bodied linseed oil or a thermoplastic resin which dry by evaporation of a volatile solvent or by oxidation or polymerization of a drying oil or resin and those dyes which are useful in the improved method for transferring single and multicolored images 10 onto substrates 18 of the invention.

The softenable inks 16 usable in the improved method for transferring images 10 onto substrates 18 of the invention vary widely. These inks 16 may be heat softenable inks, solvent softenable inks or radiation softenable inks or any other softenable inks known. Heat softenable inks 16 include photocopy or laser printer toners, sublimation inks, and the like used in printers or photocopy machines. A great variety of softenable inks 16 in a variety of colors are readily available. For the most part, these inks are homogeneous mixtures of softenable resins and pigments to produce the desired color. Included in the available softenable inks are the HP laser jet toners such as sold under the identification HPC3104A by the Hewlett Packard Company, Inc. of Palo Alto, Calif. USA and the Ricoh type toners used in Ricoh color photocopiers as sold by Ricoh Company Ltd. of Ohtaku, Tokyo, Japan which are thermoplastic polyester resins having a softening point of about 125° C. and flow points in excess of about 200° C.

The term "particle size" as used herein or the term "size" or "sized" as used herein in reference to the term "particles," means the volume weighted diameter as measured by conventional diameter measuring devices such as a Colter Multisizer, sold by Colter, Inc. The term "glass transition temperature" or "TG" as used herein means the temperature at which a polymer changes from a glassy state to a rubbery state. This temperature can be determined by differential thermal analysis as disclosed in "Techniques and Methods Of Polymer Evaluation," Vol. 1, Marcelle Decker, Inc., New York 1966.

The term "fusing temperature" as used herein means the surface temperature of a fuser member (e.g., a fuser roller) at which images of satisfactory quality can be produced. The term "melt viscosity" as used herein means the complex viscosity of a polymer measured at a particular melt temperature and a particular frequency of oscillation. Melt viscosity is measured on a Reometrics dynamic analyzer. The term "melting temperature" or "$T_m$" as used herein means the temperature at which a polymer changes from a crystalline state to an amorphous state. This temperature ($T_m$) can be measured by differential thermo analysis as disclosed in "Techniques and Methods Of Polymer Evaluation."

The heat softenable inks 16 usable in the improved method for transferring single and multicolored images 10 onto substrates 18 of the invention have "fusing temperatures" from about 100° to 250° C., and more preferably from about 110° to 150° C., melting temperatures from about 50° to 125° C., glass transition temperatures from about 50° to about 100° C., and melt viscosities from about $4\times10^2$ to $5\times10^4$ as measured by a Reometrics dynamic analyzer at 150° C. and a frequency of 1 rad per second. Other resinous inks which are heat softenable or solvent softenable or radiation softenable which are pigmented in a variety of colors may also be used if available in the desired colors.

The transfer medium 14 can be any tangible medium which can be removed from the softenable inks 16 at temperatures below their melting points and glass transition temperatures leaving the softenable inks 16 with a desired surface to produce copies of the quality desired. Inasmuch as the transfer medium 14 is usually destroyed during the process, inexpensive transfer mediums 14 are preferred. Such include papers and resinous sheets. Rather ordinary, inexpensive paper has been used to transfer images 10 to substrates 18 by the improved process of the invention, however, the fibers of the paper many times are left embedded in the inks after the transfer medium 14 is removed making them less desirable. Fabrics can also be used as transfer mediums 14 however, many fabrics leave a pattern on the ink surface once transferred to the substrate 18 making them less desirable for some applications. Sheets of resinous material can also be used. Resinous sheet material has the advantage of a smooth surface. Those resinous sheets which will not soften at temperatures less than 250° C. on which images may be printed make excellent transfer mediums 14.

Papers and resinous sheets coated with softenable resins or wax coatings also have been found desirable. Such coatings must be softenable by methods other than the methods used for softening the ink 16 to be usable in the process of the invention. For example, when using heat softenable inks 16, solvent softenable coatings may be used with great success. With solvent softenable inks 16, heat softenable coatings can be used, and radiation softenable coatings can be used with both heat softenable inks 16 and solvent softenable inks 16. One such transfer medium 14 which has been successfully used with the invention are thermal transfer papers such as used with thermal transfer printers 22 have been used. These materials are coated with water soluble materials. When used with heat or radiation softenable non water soluble inks 16, such transfer mediums 14 work well.

One such transfer medium 14 that works well with the invention are the thermal transfer receiving papers which can be purchased from New Oji Paper Co., Ltd. of Tokyo, Japan and are described more fully in U.S. Pat. No. 5,418,057. Particularly useful are those thermal transfer papers in which the coating thereon is clay and water soluble.

Also usable as well are the clay coated thermal transfer receiving papers as sold by Kanzaki Paper Mfg. Co., Ltd. of Tokyo, Japan and more fully described in U.S. Pat. No. 5,302,576, such as the KTT 10 and 20 papers.

In making transfers, especially between planar transfer mediums 14 and planar substrates 18, it is desirable for the duplicated mirror image 12 of the image 10 to be in a softenable ink 16 of a uniform thickness. Otherwise, it is difficult to place the mirror image 12 in contact with the substrate 18 throughout and over the entire image. However, transfer can still be made with some risk of blurring the images. Uniform thickness is also desirable but not as critical when using flexible transfer mediums 14 in a press 24 inasmuch as the flexibility of the transfer medium 14 will allow the duplicated mirror image 12 to contact the substrate 18 at all positions along the image.

The transfer can usually be accomplished in any type of press 24 used for transfer of images. In commercial operations of the method of transferring images 10 onto substrates 18 of the invention in which heat softenable inks 16 are used, laminators can be used as the press 24 to transfer the mirror image 12 to the substrate 18. Using the same inks 16, a press 24 in an oven can be used to transfer the images. When using solvent softenable inks, or radiation softenable inks, presses 24 exposed to solvent and/or radiation, respectively can be used.

The particular press 24 used in performing the method of the invention is not as critical as the transfer medium used or the inks 16 used. The press 24 can be of any type in which the inks 16 can be softened and the mirror image 12 can be placed in contact with the surface of the substrate 18 over the entire area of the image 10. Pressure between the transfer medium 14 and the substrate 18 need not be great. Pressure is only required to ensure that the mirror image 12 is in contact with the substrate 18 over the entire expanse of the image 12. Additional pressure should not be applied to the mirror image 12 as the inks 16 may flow and the image 10 blur when the inks 16 softened and the image is bonded to the substrate 18.

The mirror image 12 is then transferred to the desired substrate 18. The transfer step of the invention is broken down into two steps. First, the mirror image 12 is bonded to the substrate 18. After bonding the mirror image 12 to the substrate 18, the mirror image 12 is bonded to both the substrate 18 and the transfer medium 14. The second step of the transfer is removing the transfer medium 14 from the image 12 without any damage to the image 12 or the bond of the image 12 to the substrate 18.

The mirror image 12 on the transfer medium 14 is bonded to the substrate 18 by softening the ink 16 on the transfer medium 14 when in contact with the substrate 18 and hardening the ink 16 of the image 20. The mirror image 12 is then equally bonded to the substrate 18 and the transfer medium 14. The transfer medium 14 then must be removed from the image 12, 20. Such can occur when using papers, coated papers, or polymer sheets and the like by solvent removal. When using wax or resin coated papers or fabrics or resinous sheets, the same can be accomplished by soaking the substrate 18 in a solvent 26 for the wax or resin and washing the transfer medium 14 paper and its coating from the image 12, 20 leaving the image 12 on the substrate 18 as if printed directly on the substrate 18. When utilizing water and a water soluble wax or resin coating or transfer medium, adding a detergent and/or a surfactant and/or an emulsifier to the water may be useful depending upon the wax or resin used. In other applications, other solvents, combinations of water and other solvents or just water may be usable.

In those transfer mediums 14 utilizing thermally stable solvent softenable inks 16 and thermally stable radiation softenable inks 16, the transfer mediums 14 can be removed by applying heat to the transfer medium 14. Other examples of softenable inks 16 and removable transfer mediums 14 exist which are usable with the method of the invention.

The resulting substrate 18 having the transferred image 20 thereon can then be finished as desired. Lacquer coatings can be placed over the substrate 18. The substrate 18 may be framed like pictures or wall hangings. The substrate 18 may be finished in any number of ways well known to the prior art.

The following examples are presented herein to more fully illustrate the present invention:

EXAMPLE 1

Figure 2:
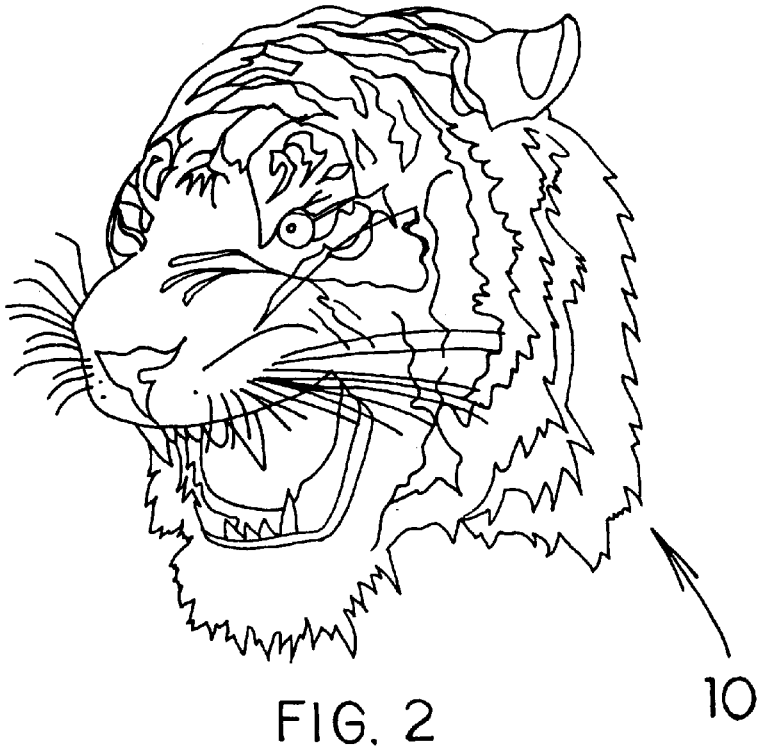
FIG. 2 is a planar view of a multicolored mirror image applied to the transfer paper.
Figure 3:
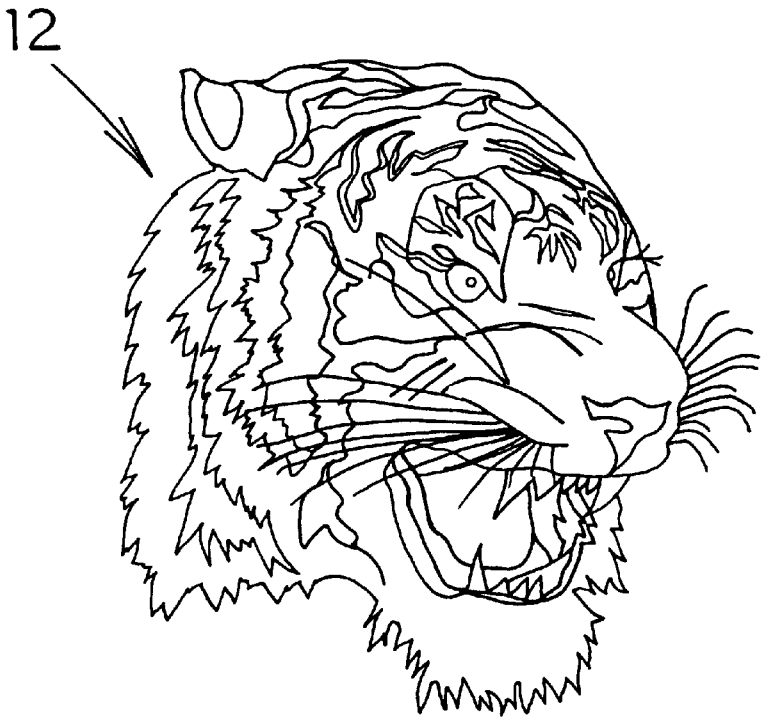
FIG. 3 is a copy of the transferred image of FIG. 2 by the improved method of the invention.

An image 10 of a multicolored tiger as shown in FIG. 2 is drawn on a computer screen. The image 10 is printed as a mirror image 12 on premium grade thermal transfer receiving paper 14 as manufactured and sold by Kanzaki Paper Mfg. Co., Ltd. of Tokyo, Japan by a HP Color Laserjet 5 printer 22 using HP 3100 series polyester toners 16. The transfer paper 14 and image 12 as shown in FIG. 3 is placed against a substrate 18 in the form of an enameled metal sheet with the mirror image print 16 between the paper 14 and the substrate 18. The substrate metal sheet 18 and paper 14 composite is placed in a laminator press 24 at a temperature of about 140° C. After passing through the laminator 24, the transfer paper 14 is removed from the laminate by spraying the same with a water solution 26 and a household detergent which includes surfactant and emulsifiers. The transfer paper 14 is separated from the substrate 18 leaving the printed image 20 on the substrate 18. The substrate 18 is then washed with clear water to remove the detergent from the substrate 18. The substrate 18 is then heated in an oven at about 180° C. in order to cure the resinous toner 16 and secure the image 20 to the substrate 18, and lacquered.

EXAMPLE 2

An image 10 of a multimedia presentation is printed as a mirror image 12 on premium grade thermal transfer receiving paper 14 as manufactured and sold by Kanzaki Paper Mfg. Co., Ltd. of Tokyo, Japan by a Konica photocopier 22 model no. Royal 2298 utilizing Konica brand polyester toners 16. The transfer paper 14 is placed against a substrate 18 of polished stainless steel sheet metal with the mirror image print 12 between the paper 14 and the substrate 18. The substrate metal sheet 18 and the paper 14 composite is placed in a press 24 and heated for one minute at 180° C. in a conventional oven. After removing the bonded laminate of the transfer paper 14 and the substrate 18 from the oven, the paper 14 is removed from the substrate 18 by spraying the same with a water solution and a household detergent which includes surfactants and emulsifiers. The water solution 26 will penetrate the paper 14 and permit easy removal of the paper 14 from the image 12, 20 after about 30 seconds. The paper 14 is separated from the substrate 18 leaving the printed image 20 on the substrate 18. The substrate 18 is then washed with clear water to remove the detergent from the substrate 18. The pigmented thermal plastic toner 16 of the image 20 is fully cured and secured to the substrate 18. Once the metal is clean, it is ready for spray coating with lacquer or other finishing as desired.

EXAMPLE 3

A copy of "The Bridge" by Monet 10 is made on a Ricoh color photocopier 22 model no. VC 5006 as a mirror image 12 on thermal transfer receiving paper 14 as manufactured and sold by New Oji Paper Co., Ltd. of Tokyo, Japan using Ricoh type toners 16. The sheet of absorbits as sold by Lutz Enterprises, Inc. of Walnut Creek, Calif. is placed on top of a previously finished board with a high temperature coated surface and a sheet of 0.020 inch thick brass is placed on the absorbits to form a laminate. The entire laminate is placed in a press 24 and heated with light pressure at about 180° C. for 45 seconds to remove moisture therefrom. After inspection of the image 12 and approval of the quality thereof, the image 12 and transfer paper 14 is additionally dried by heating for an additional 15 seconds at about 170° C. After the laminate and transfer paper 14 are fully dried, the transfer paper 14 is placed on the board substrate 18 with the image 12 between the board substrate 18 and the transfer paper 14. A sheet of absorbits is placed on top of the paper 14 and a brass sheet 18 is placed on top of the absorbits sheet. The board 18 with paper 12, absorbits and brass sheet and board 18 is placed as a laminate in a press 24 and heated for one minute at 170° C. After removing the composite laminate from the press 24, the brass sheet and absorbits are removed. The thermal paper 14 is then removed from the image 12, 20 by spraying the same with a water solution and a household detergent 26 which includes surfactants and emulsifiers. The thermal paper 14 is separated from the substrate 18 leaving the image 12 on the substrate 18. The substrate 18 is then washed with clear water to remove detergent 26 from the substrate 18. The pigmented thermal plastic toner 16 of the image 20 is then fully cured and the image 20 is secured to the substrate 18. After cleaning the board 18 with clear water, the plaque is completed as desired.

EXAMPLE 4

An image 10 of a multimedia presentation is printed as a mirror image 12 on premium grade thermal transfer receiving paper 14 as manufactured and sold by Kanzaki Paper Mfg. Co., Ltd. of Tokyo, Japan by a Konica photocopier 22 model no. Royal 2298 utilizing Konica brand polyester toners 16. The transfer paper 14 is placed against a substrate 18 of polished stainless steel sheet metal coated with lacquer with the mirror image print 12 between the paper 14 and the substrate 18. The paper 14 is sprayed with a solvent until the paper 14 is noticeably wet. The paper 14 is dried and the paper 14 turns white in color. The paper 14 with the mirror image 12 thereon is placed on the metal sheet 18 with the mirror image 12 therebetween. The substrate metal sheet 18 and the paper 14 composite is placed in a press 24 and heated for about one minute at 180° C. in a conventional oven. After removing the laminated transfer paper 14 and substrate 18 from the oven and cooling the same, the paper 14 is removed from the laminate by spraying the same with a water solution and a household detergent 26 which includes surfactants and emulsifiers. The water solution 26 will penetrate the paper 14 and permit easy removal of the paper 14 from the image 12, 20 after about 30 seconds. The paper 14 is separated from the substrate 18 leaving the printed image 20 on the substrate 18. The substrate 18 is then washed with clear water to remove the detergent from the substrate 18. The pigmented thermal plastic toner 16 of the image 20 after being cleaned is fully cured and secured to the substrate 18 by heating in the oven at about 150° C. for about 5 minutes. Once the metal is cooled it is ready for spray coating with lacquer or other finishing as desired.

EXAMPLE 5

A copy of the bridge by Monet 10 is made on a Ricoh color photocopier 22 model no. NC 8115 as a mirror image 12 on a premium grade thermal transfer receiving paper 14 as manufactured and sold by New Oji Paper Co., Ltd. of Tokyo, Japan as a mirror image 12 using Ricoh type toner in magenta, black, cyan and yellow colors 16. The sheet of absorbits is placed on top of the transfer paper 14, and a sheet of 0.020 inch thick brass is placed on the absorbits forming a laminate. The transfer paper 14 is placed on the substrate 18 in the form of a recently lacquered wood board with the mirror image 12 therebetween. The entire laminate is placed in a press 24 and heated in an oven to 60° C. for one minute. After removing the composite laminate from the press 24, the brass sheet and absorbits are removed. The transfer paper 14 is then removed from the image 12, 20 by spraying the same with a water solution and a household detergent 26 which includes surfactants and emulsifiers. The water solution 26 will penetrate the paper 14 and permit removal of the paper 14 from the substrate 18 after about 30 seconds. The transfer paper 14 is separated from the substrate 18 leaving the printed image 20 on the lacquered wood board 18. The lacquered wood board 18 is then washed with clear water to remove detergent from the substrate. The pigmented thermal plastic toner 16 of the image 20 is fully cured and the image 20 is secured to the substrate 18. After drying the board 18, the board 18 is completed by applying a uniform coating of lacquer.

EXAMPLE 6

An image of the multicolored tiger 10 as shown in FIG. 2 is drawn on a computer screen and printed as a mirror image 12 by an HP Color Laser Jet 5 printer 22 onto copy paper 14 such as 00501-5 paper manufactured and sold by Hammermill Paper Co. of Rochester, N.Y. as a mirror image 12 using HP 3100 Series polyester toners 16. The transfer paper 14 is placed onto a metal substrate 18 with the image 12 therebetween and held in place with tape. This assembly is then placed in a press 24 and heated for about 1 minute at about 180° C. After removing the paper 14 and substrate 18 from the press 24, the paper 14 is bonded to the substrate 18 by the image 12 forming a paper 14 heat softenable ink 16 and substrate 18 laminate. The paper 14 is removed from the laminate by soaking the same in a detergent solution 26 for about 1 hour. After the laminate is removed from the detergent solution 26, the paper 14 may be rubbed off the substrate 18 leaving the image 20 deposited on the metal substrate 18. The substrate 18 is then washed with clear water to remove the detergent solution from the substrate 18. The substrate 18 is then heated in an oven at about 180° C. in order to cure the ink 16 and secure the image 20 to the substrate 18. The substrate 18 is then lacquered or otherwise finished as desired.

EXAMPLE 7

An image of the multicolored tiger 10 as shown in FIG. 2 is drawn on a computer screen and printed as a mirror image 12 by an BP Color Laser Jet 5 printer 22 onto copy paper 14 such as 00501-5 manufactured and sold by Hammermill Paper Co. of Rochester, N.Y. as a mirror image 12 using HP 3100 Series polyester toners 16. The copy paper 14 is placed onto a metal substrate 18 with the image 12 therebetween and held in place with tape. This assembly is then placed in a press 24 and heated for about 1 minute at about 180° C. After removing the paper 14 and substrate 18 from the press 24, the paper 14 is bonded to the substrate 18 by the image 12 forming a paper 14, heat softenable ink 16 and substrate 18 laminate. The paper 14 is removed from the laminate by soaking the same in a detergent solution 26 for about 1 hour. After the laminate is removed from the detergent solution 26, the paper 14 may be rubbed off the substrate 18 leaving the image 20 deposited on the metal substrate 18. The substrate 18 is then washed with clear water to remove the detergent solution 26 from the substrate 18. Most of the fibers may be removed by additional washing and rubbing the image 20. The substrate 18 is then heated in an oven at about 180° C. in order to cure the ink 16 and secure the image 20 to the substrate 18. The substrate 18 is then lacquered or otherwise finished as desired. The image 20 may have some paper fibers secured thereto.

EXAMPLE 8

An image of a multicolored tiger 10 as shown in FIG. 2 is printed using an HP Color Laser Jet 5 printer 22 (not as a mirror image) on a sheet of premium grade thermal transfer receiving paper 14 as manufactured and sold by Kanzaki Paper Mfg. Co., Ltd. of Tokyo, Japan using HP 3100 Series polyester toners 16. The transfer paper 14 is sprayed with a mist of solvent compatible with the solvent of the HP Laser Jet 3100 series polyester toners 16 until the surface is notably wet. Allow the paper 14 to dry for about 1 minute after the paper 14 turns from transparent to white. The paper 14 is placed onto a Plexiglas acrylic substrate 18 and held in place with tape, with the image 12 therebetween. This assembly is then placed in a press 24 with a sheet of absorbits on top of the image 12 and a sheet of brass placed on the absorbits. This forms a brass absorbit image paper 14 and substrate 18 laminate. The laminate is heated with light pressure for about 1 minute at about 75° C. After removing the laminate from the press 24, the brass sheet and absorbit is removed and the paper 14 is sprayed with a water and detergent solution 26. The solution 26 will penetrate the paper 14 and permit easy removal of the paper 14 from the image 20 after about 30 seconds. The paper 14 is then separated from the substrate 18 and the image 20 leaving the printed image 20 on the Plexiglas acrylic sheet substrate 18. The substrate 18 and image 20 are thoroughly washed to remove all of the detergent solution 26 therefrom. The substrate 18 can then be framed with the image 20 being viewed through the Plexiglas acrylic substrate 18 from the side opposite that to which the image 20 is adhered.

EXAMPLE 9

An image of a multicolored tiger 10 as shown in FIG. 2 is printed as a mirror image 12 onto copy paper 14 such as 00501-5 paper manufactured and sold by Hammermill Paper Co. of Rochester, N.Y. utilizing a Cannon NP-3525 copier 22 using Cannon NP toner 16 sold for the copier. The transfer paper 14 with the image 12 thereon is placed with the print 16 against the substrate 18 forming a laminate. The laminate is then passed through a laminator 24 with the heat set at 140° C. Immediately after passing through the laminator 24, the paper 14 is separated from the substrate 18 leaving the printed image 20 on the substrate 18. The substrate 18 may be washed or otherwise cleaned, if necessary, the substrate 18 is then heated in an oven to a temperature of about 180° C. to bond the image 20 to the substrate 18. The substrate 18 may then be lacquered or otherwise finished as desired.

EXAMPLE 10

An image 10 of a printed circuit board is printed as a mirror image 12 on premium grade thermal transfer receiving paper 14 as manufactured and sold by Kanzaki Paper Mfg. Co., Ltd. of Tokyo, Japan by a Hewlett-Packard Laser Jet 4 printer. The transfer paper 14 is placed against a substrate 18 comprising a copper foil on a base plate for a printed circuit board with the mirror image print 12 between the paper 14 and the substrate 18. The substrate 18 and the paper 14 composite is placed in a press 24 and heated for 1 minute at 180° C. in a conventional oven. After removing the bonded laminate of the transfer paper 14 and the substrate 18 from the oven, the paper 14 is removed from the substrate by spraying the same with water solution and household detergent which includes surfactants and emulsifiers. The water solution 26 will penetrate the paper 14 and permit easy removal of the paper 14 from the image 12, 20 after about 30 seconds. The paper is separated from the substrate 18 leaving the printed image 20 on the substrate 18. The substrate 18 is then washed with clear water to remove the detergent from the substrate. The image 20 is fully cured and secured to substrate 18. Once the metal is clean, it is ready for etching.

Etching is accomplished in accordance with the process disclosed in U.S. Pat. No. 5,180,465 utilizing one or more of the acid or alkaline etching solutions disclosed. Etching occurs only where no portion of image 20 is applied to the substrate. Image 20 being of polyester ink acts as a barrier to the ferric chloride and acid and alkaline solutions commonly used for etching metals.

After etching has been accomplished, the image is removed from the substrate 18 utilizing a citrus based solvent such as that sold by Texas Original Graphics of Irving, Tex. as a sublimation cleaner.

After the etching is finished, the printed circuit boards are rinsed with water and dried.

EXAMPLE 11

An image 10 using a Hewlett-Packard Laser Jet 4 printer 22 on a sheet of premium grade thermal transfer receiving paper 14 as manufactured and sold by Kanzaki Paper Mfg. Co., Ltd. of Tokyo, Japan using HP 3100 Series polyester toner 16. The transfer paper 14 is sprayed with a mist of solvent compatible with the solvent of the HP Laser Jet 3100 Series polyester toner 16 until the surface is notably wet. The paper is allowed to dry for about 1 minute after the paper 14 turns from transparent to white. The paper 14 is placed onto a glass substrate 18 and held in place with tape, with the image 12 therebetween. This assembly is then placed in a press with a sheet of absorbits on the top of the image 12 and a sheet of brass placed on the absorbits. This forms a brass, absorbits, image, paper and glass substrate 18 laminate. The laminate is heated with light pressure for about 1 minute at about 250° F. After removing the laminate from the press 24, the brass sheet and absorbits is removed and the paper 14 is sprayed with a water and detergent solution 26. The solution 26 will penetrate the paper 14 to permit easy removal of the paper 14 from the image 20 after about 30 seconds. The paper 14 is then separated from the substrate 18 and the image 20 leaving the printed image 20 on the glass sheet substrate 18. The substrate 18 and image 20 are thoroughly washed to remove all of the detergent solution 26 therefrom. The substrate 18 can then be framed with the image 20 being viewed through the glass substrate 18 from the side opposite that to the image 20 to which the image 20 is adhered.

EXAMPLE 12

An image 10 using a Hewlett-Packard Laser Jet 4 printer 22 on a sheet of premium grade thermal transfer receiving paper 14 as manufactured and sold by Kanzaki Paper Mfg. Co., Ltd. of Tokyo, Japan using HP 3100 Series polyester toner 16. The transfer paper 14 is sprayed with a mist of solvent compatible with the solvent of the HP Laser Jet 3100 Series polyester toner 16 until the surface is notably wet. The paper is allowed to dry for about 1 minute after the paper 14 turns from transparent to white. The paper 14 is placed onto a glass substrate 18 and held in place with tape, with the image 12 therebetween. This assembly is then placed in a press with a sheet of absorbits on the top of the image 12 and a sheet of brass placed on the absorbits. This forms a brass, absorbits, image, paper and glass substrate 18 laminate. The laminate is heated with light pressure for about 1 minute at about 250° F. After removing the laminate from the press 24, the brass sheet and absorbits is removed and the paper 14 is sprayed with a water and detergent solution 26. The solution 26 will penetrate the paper 14 to permit easy removal of the paper 14 from the image 20 after about 30 seconds. The paper 14 is then separated from the substrate 18 and the image 20 leaving the printed image 20 on the glass sheet substrate 18. The substrate 18 and image 20 are thoroughly washed to remove all of the detergent solution 26 therefrom.

The glass substrate 18 is then heated at 250° F. for 30 minutes to improve the adhesion of the image 20 to the glass.

The substrate 18 can then be etched with etching creams such as that sold by Armour Products of Midland, Park, N.J. The glass surface not protected by the image 20 will be etched. The image 20 can then be removed by soaking the etched glass in a solvent of the HP Laser Jet 3100 polyester toner 16.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto:

What is claimed is:

1. A method for transferring single color and multicolor images to substrates comprising the steps of duplicating said image as a mirror image in softenable ink on a transfer medium in the color desired, superimposing said transfer medium over a desired substrate with said mirror image therebetween, placing all portions of said mirror image in intimate contact with said substrate with no space therebetween, softening said ink to bond said image and substrate together thereby forming a composite in which said image is adhesively secured to both said transfer medium and said substrate, and removing said transfer medium from said image and said substrate without softening said ink by washing said transfer medium from said image and substrate.

2. The method of claim 1 wherein said duplicating step is performed in a copier chosen from the group consisting of photocopy machines, facsimile machines, and printers.

3. The method of claim 2 wherein said image is duplicated by a computerized printer.

4. The method of claim 1 wherein said transfer medium is chosen from the group consisting of paper sheets, cloth sheets, and resinous sheets.

5. The method of claim 1 wherein said ink is a thermoplastic resin ink having colored pigment therein.

6. The method of claim 5 wherein said thermoplastic resin of said ink is a polyester resin having a softening point from about 50° C. to about 125° C. and a flow point above 200° C.

7. The method of claim 5 wherein said thermoplastic resin has a glass transition temperature below 150° C. and spaced from its flow point more than 30° C.

8. The method of claim 1 wherein said softenable ink has a flow point and a softening point spaced apart by more than 30° C.

9. A method for transferring single color and multicolor images to substrates comprising the steps of duplicating said image as a mirror image in softenable ink on a transferable medium in the color desired, superimposing said transfer medium over a desired substrate with said mirror image therebetween, placing all portions of said mirror image in intimate contact with said substrate with no space therebetween, softening said ink to bond said image and substrate together thereby forming a composite in which said image is adhesively secured to both said transfer medium and said substrate, and removing said transfer medium from said image and substrate by at least partially destroying said transfer medium without softening said ink.

10. The method of claim 1 wherein said ink is softenable by radiation, said transfer medium being not softenable by radiation, said transfer medium being solvent soluble.

11. The method of claim 1 wherein said transfer medium is flexible and capable of conforming to the surface of said substrate.

12. The method of claim 9 wherein said transfer medium is provided with a softenable coating on which said image is duplicated as a mirror image.

13. The method of claim 1 wherein said transfer medium is provided with a softenable coating on which said image is duplicated as a mirror image.

14. The method of claim 13 wherein said coating is softenable by means for softening said coating which will not soften said ink.

15. The method of claim 13 wherein said coating is not heat softenable and said ink is heat softenable.

16. The method of claim 15 wherein said ink is heat softenable and said coating is solvent softenable.

17. The method of claim 13 wherein said coating is not radiation softenable, said ink is radiation softenable, said coating being solvent softenable.

18. The method of claim 15 wherein said coating is water soluble.

19. The method of claim 18 wherein said coating is a thermally stable resin to about 200° C.

20. The method of claim 12 wherein said coating is a water soluble resin which is thermally stable below about 200° C.

21. The method of claim 1 wherein said bonding step includes pressing said transfer medium and substrate together with said ink therebetween and softening said ink.

22. The method of claim 21 wherein said bonding step is accomplished between the rolls of a laminator.

23. The method of claim 21 wherein said bonding step is accomplished in a heated press.

24. The method of claim 23 wherein said coating is solvent soluble.

25. The method of claim 23 wherein said coating and transfer medium are solvent soluble.

26. The method of claim 23 wherein said solvent of said coating is water.

27. The method of claim 25 wherein said solvent of said coating and transfer medium is water.

28. The method of claim 27 wherein the softening of said coating and transfer medium may be hastened by the adding of detergents, surfactants and emulsifiers to said water.

29. The method of claim 1 wherein said image is a single color image applied to an etchable substrate further comprising the steps of etching said substrate with an etching medium and removing said etching medium and said image from said substrate after etching has occurred.

30. The method of claim 29 wherein said substrate is a copper foil provided on a base plate for a printed circuit board.

31. The method of claim 29 wherein said substrate is glass.

32. The method of claim 23 wherein said ink is heat softenable and said coating is not heat softenable.

33. The method of claim 1 wherein said substrate is chosen from the group of substrates consisting of wood, metal, glass, ceramic, plastic, leather, rubber, plasters, and composites of the same.

34. The method of claim 9 wherein said softenable ink is softenable by a solvent, said solvent not being a solvent of said transfer medium or said substrate, said solvent not being chemically reactive with said transfer medium or said substrate.

35. The method of claim 9 wherein said transfer medium is chosen from the group consisting of paper and fabric and resin sheets.

36. The method of claim 12 wherein said coating is softenable by means for softening said coating which will not soften said ink.

* * * * *